United States Patent [19]

Lambrecht

[11] Patent Number: 4,610,623

[45] Date of Patent: Sep. 9, 1986

[54] GAS BURNER

[75] Inventor: Heinrich Lambrecht, Neuenstadt, Fed. Rep. of Germany

[73] Assignee: Deutsche Forschungs- und Versuchsanstalt für Luft- und Raumfahrt e.V., Bonn, Fed. Rep. of Germany

[21] Appl. No.: 705,065

[22] Filed: Feb. 25, 1985

[30] Foreign Application Priority Data

Mar. 3, 1984 [DE] Fed. Rep. of Germany ..... 3407882

[51] Int. Cl.[4] ..... F23D 11/44

[52] U.S. Cl. ..... 431/243; 431/263; 431/354

[58] Field of Search ..... 431/242, 243, 263, 264, 431/354, 191

[56] References Cited

U.S. PATENT DOCUMENTS

| | | | |
|---|---|---|---|
| 3,627,457 | 12/1971 | Roder | 431/263 X |
| 4,295,820 | 10/1981 | Röeder et al. | 431/264 X |
| 4,416,613 | 11/1983 | Barisoff | 431/243 |

FOREIGN PATENT DOCUMENTS

| | | |
|---|---|---|
| 1915323 | 10/1969 | Fed. Rep. of Germany . |
| 2304215 | 9/1973 | Fed. Rep. of Germany . |

*Primary Examiner*—Margaret A. Focarino
*Attorney, Agent, or Firm*—Kenway & Jenney

[57] ABSTRACT

A gas burner capable of heating a gas to a high temperature and pressure is disclosed. The burner utilizes a mixing canal to mix the fuel and oxidiser gases and a conically enlarging recess at the exit of the mixing canal. In the recess are both several intake openings for the gas to be heated which openings extend from feeder canals that are parallel to the mixing canal and a side canal leading to an ignition mechanism. The intake openings provide a gas-dynamic blockage of the fuel and oxidiser gas mixture.

9 Claims, 3 Drawing Figures

GAS BURNER

BACKGROUND OF THE INVENTION

The invention concerns a gas burner with a feeder for burnable gas and with an ignition mechanism for igniting the combustible gas mixture.

For bringing a gas to a high temperature by means of a gas burner, there are difficulties in the usual gas burners if high pressure and temperature ranges are used. Most of the known gas burners can only be used for limited pressure and temperature values.

It is the task of the present invention to create a gas burner in which a gas can be heated within a high temperature and pressure range.

SUMMARY OF THE INVENTION

This task is solved with a gas burner of the type described above according to the invention in such a way that the burner has a conically enlarging recess in whose tip is joined a feeder for burnable gas to form a junction; that this junction is surrounded by a multitude of intake openings for the gas to be heated which are formed by the feeder canals for the gas to be heated which are parallel to the axis and which penetrate through the walls of the conical recesses, and that a side canal branches off in the region between the junction and the feeder openings which leads to the ignition mechanism.

It has been surprisingly shown that this simple device solves the task posed by the invention in an outstanding fashion. This arragement particularly results in an outstanding ignition reliability, as the ignition mechanism, for example a glow plug, is in close contact with the burnable mixture before igniting and the mixture is sent from the junction by way of the side canal to the ignition mechanism. By means of the feeder openings surrounding the junction in the conical wall, a gas-dynamic blockage of the burnable gas flow results, that is, the burnable gas flowing out of the junction cannot flow freely into the combustion chamber adjoining the conical recess, but is here dammed up. Through this the burnable gas enters a narrow branching canal to the ignition mechanism to such a far extent that a reliable ignition is possible. As soon as ignition is completed, it was also surprisingly shown that no flammable mixture reaches the ignition mechanism any more, that is, the flammable mixture is directed after the ignition into the combustion chamber immediately, passing the sideways branching canal, and burns there. It was also shown that with such an arrangement a backfiring of the flame can be effectively prevented, that is, by means of the lateral feeder openings in the conical recess the flame front can be localized downstream from the junction without there being a danger of backfiring.

The already mentioned gas-dynamic blockage of the burnable gas has, furthermore, the big advantage that such a burner can be installed next to an already operating burner and that the operating burner still does not ignite the unconnected burner, since the burnable gas of the unconnected burner cannot enter freely into the combustion chamber due to this gas-dynamic blockage. With this is guaranteed that the ignition of every gas burner happens only through a specifically provided ignition mechanism, even when a number of gas burners are used.

It is furthermore guaranteed in operation that the ignition mechanism is not heated up, since the flame front is localized downstrean of the canal leading to the ignition mechanism. In this way the ignition mechanism is not stressed or worn out.

The preferred construction type is designed such that the junction is connected with a mixer canal which is surrounded by the feeder canals running parallel to it for the gas to be heated. Here intake feeders for two different burnable gas components can join here. It is here of advantage if an intake feeder with an injector jet joins into the mixer canal, while another enters in the suction range of this injector jet into the mixer canal. In this way the one burnable gas component drives the other burnable gas component into the mixer canal, so that a turbulent flow results which leads to a complete mixing.

The preferred construction type is designed such that the feeder canals are connected to a supply line which sends the gas to be heated from a heat exchange chamber lying downstream of the conical recess and next to the combustion chamber to the feeder canals. In this way the gas to be heated is already being pre-heated before it enters into the conical recess through the feeder canals.

It is of advantage if the conical recess as well as the feeder canals are located in a burner part which is set into a case which sends the gas to be heated to the feeder canals. Here it is easily possible to replace such a burner part.

Preferrably, the burner part consists of a metal with a good heat conductivity so that the gas to be heated that is sent to the case can effectively cool the burner part.

The two burnable gas components could, for example, be oxygen and hydrogen, preferrably these are introduced in a stochiometric ratio.

In a preferred construction type a bypass line is also provided to introduce burnable gas or parts thereof downstream of the intake openings into the combustion chamber adjoining the conical recess. Through this it is possible to bring larger amounts of burnable gas into the combustion chamber without the flow velocity in the mixer canal and in the junction becoming so great that the flame propagation speed is exceeded.

BRIEF DESCRIPTION OF THE DRAWINGS

The following description of preferred construction types of the invention serves as an explanation in connection with the figures. The following show.

DETAILED DESCRIPTION OF THE PREFERRED EMBODIMENTS

Figure 1:
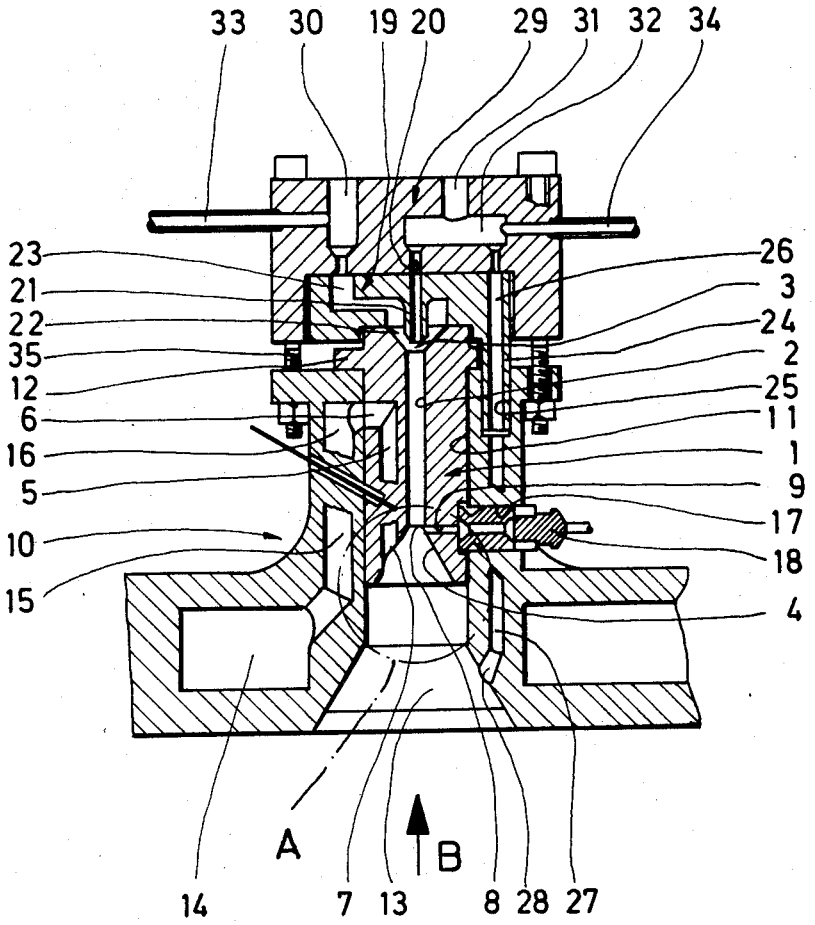
FIG. 1 shows a sectional view through a gas burner with a gas-dynamic blockage
Figure 3:
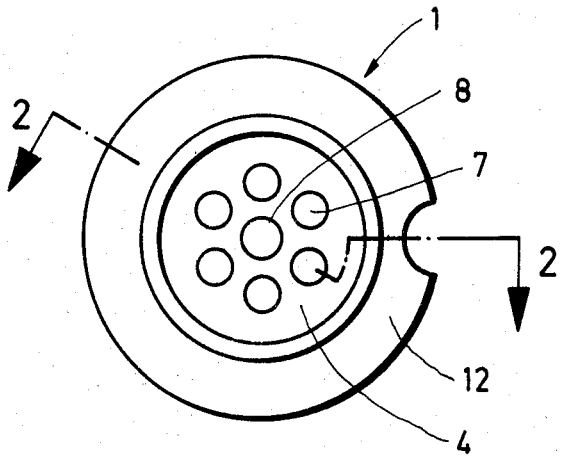
FIG. 2 shows an enlarged sectional view along line 2—2 in FIG. 3 of a burner part and FIG. 3 shows a view of the burner part of FIG. 2 in the direction of the arrow B.
Figure 2:
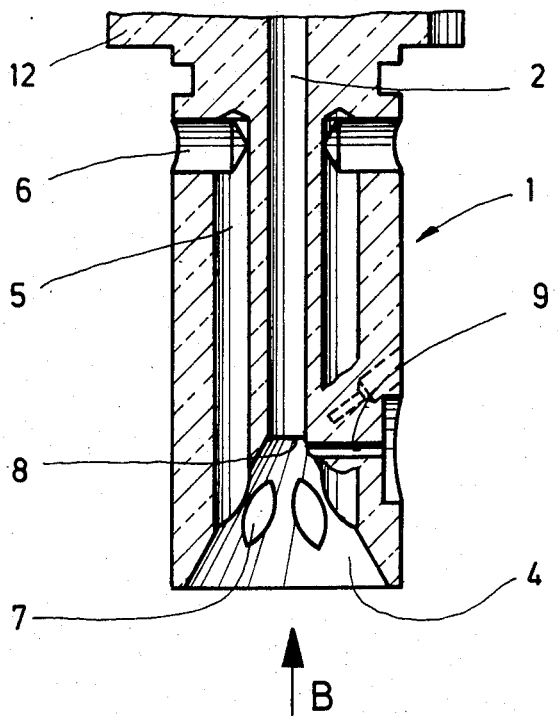

The burner shown in the figure consists of a cylindrical burner part 1 made of a metal with high heat conductivity with a central longitudinal bore forming a mixer canal 2 which has a funnel-shaped recess 3 in its intake side, while it joins at its outlet end into the tip of a recess 4 that is extended in a conical or funnel-shaped form. The mixer canal 2 is surrounded by numerous feeder canals 5 running parallel to it which at their upper ends have bores 6 leading radially to the outside. The feeder canals 5 join into the inclined wall of the conical recess 4 and form there a number of intake openings 7 which surround the junction 8 of the mixer canal 2 into the recess 4 (FIGS. 2 and 3). In the construction type shown, six feeder canals 5 are provided for but this number can be changed.

In the region between the junction 8 and the intake opening 7, a canal 9 radially oriented to the outside branches off from the recess 4 and leads to the outer perimeter of the burner part 1.

The burner part 1 is set into a connecting bore 11 of a case 10 and is supported against it by a ring shoulder 12. The case forms a combustion chamber 13 adjoining and extending the conical recess 4 of the burner part 1 and surrounds it with a heat exchange chamber 14, which is connected to a ring chamber 16 surrounding the burner part at the upper end of the case by way of a line 15 running parallel to the axis of the burner part. This ring chamber 16 is open toward the burner part and is arranged in such a way that a connection from this ring chamber 16 is formed to the feeder canals 5 by way of the bores 6. In this way the gas flowing through the heat exchange chamber 14 can enter into the feeder canals 5 by way of the line 15 and the ring chamber 16 and can reach into the conical recess and the adjoining combustion chamber by way of the intake openings 7.

Additionally, there is in the case a lateral chamber 17 for the insertion of an auto-ignition means 18; this chamber is connected with the canal 9 in the burner part 1.

On the upper side of the burner part 1 there is a dosing lid 19, which has a central connecting bore 20 which ends in the form of an injector jet 21 and is dipped into the extension 3 of the mixer canal 2. This injector jet 21 is connected by a ring chamber 22 connected to the extension of the mixer canal which leads to a laterally located intake opening 23 on the upper surface of the dosing lid. On the opposite side the dosing lid has a pipe socket 24 projecting downward next to the burner part which dips into a stepped bore 25 in the case 10. A bore 26 going through the pipe socket joins into a bypass line 27 in the case 10, which leads to an outlet opening 28 in the wall of the combustion chamber arranged downstream of the conical recess of the burner part.

The dosing lid 19 is covered by a cap 29. This has two gas pipes 30 and 31 on its upper side whereby the one gas pipe 30 is connected with the ring chamber 22 and the other gas pipe 31 with a distributing chamber 32, which again is connected on the one part with the bore 20 of the injector jet 21 and on the other part with the bore 26 in the pipe socket 24. From the cap, two pipes 33 and 34 lead laterally from the gas pipe 30 or the distributing chamber 32 to the pressure measuring instruments not shown in the figure.

The cap 29 is pressed by the rod 35 against the case 10, whereby the burner part 1 is also pressed into the case by way of the dosing lid 19 and is fixed in it.

In operation, hydrogen is introduced through the gas pipe 30 and oxygen through the gas pipe 31. A gas to be heated, such as air, is also introduced by way of the heat exchange chamber 14, which in this way gets to the combustion chamber by way of the feeder canals 5.

The oxygen flowing by way of the distributing chamber 32 though the gas pipe 31 through the injector jet 21 takes along hydrogen from the ring chamber 22, which in the adjoining mixer canal 2 is thoroughly mixed with the oxygen, so that a hydrogen-oxygen mixture is let out at the junction 8 which is preferrably stochiometric by suitable dosing. Before ignition this burnable gas exiting there is to be hindered from freely flowing by the gas to be heated coming out of the intake openings 7, that is, there occurs a gas-dynamic blockage. In this way the burnable gas reaches the auto-ignition means 18 by way of the canal 9 and can be ignited there. Immediately after the ignition the flame spreads downstream in the combustion chamber adjoining the conical recess, and there is no danger that the flame backfires due to the construction of the burner part. Especially, neither the flame nor any burnable gas mixture reach the auto-ignition, so that the auto-ignition stays cold and no further ignition takes place, after the ignition has first ignited the gas mixture.

Additional oxygen can be introduced to the burning gas by way of the bypass line, so that this can also be burned in the combustion chamber.

I claim.

1. Gas burner with a feeder for a burnable gas mixture and an ignition device for igniting the burnable gas mixture comprising a generally cylindrical burner with a central longitudinal bore forming a mixer canal having an inlet and an outlet with the outlet having a conically enlarging recess (4) that joins the outlet with a junction (8), the junction (8) being surrounded by a number of intake openings (7) for a gas to be heated which openings lead to feeder canals (5), with the gas to be heated through the walls of the conical recess (4) parallel to the symmetry axis of the mixer canal (2) and the conical recess (4), and in an area between the junction (8) and the intake openings (7) there is a lateral canal (9) which brances off from the recess (4) and leads to the ignition device (18).

2. Gas burner according to claim 1 wherein the recess (4) is connected with a mixer canal (2) which is surrounded by feeder canals (5) for the gas to be heated running parallel to it.

3. Gas burner according to claim 2 wherein intake lines (21, 22) for two different burnable gas components enter into the mixer canal (2).

4. Gas burner according to claim 3 wherein an intake line (20) enters into the mixer canal (2) with an injector jet (21), while the other intake line enters in the suction range of this injector jet (21) into the mixer canal (2).

5. Gas burner according to claim 4 wherein the feeder canals (5) are connected with a supply line (15) which sends the gas to be heated to the feeder canals (5) from a heat exchange chamber (14) adjoining the combustion chamber and downstream from the conical recess (4).

6. Gas burner according to claim 5 wherein the conical recess (4) as well as the feeder canals (5) are located in a burner part (1) which is set into a case (10) which feeds the gas to be heated into the feeder canals (5).

7. Gas burner according to claim 6 wherein the burner part (1) consists of a metal with high heat conductivity.

8. Gas burner according to one of the claims 3 to 7 wherein the two burnable gas components are hydrogen and oxygen.

9. Gas burner according to one of the claims 1 to 7 wherein a bypass line (27) is provided for which feeds burnable gas or parts thereof downstream of the intake openings (7) into the combustion chamber adjoining the conical recess (4).

* * * * *